US005182492A

United States Patent [19]

Chen

[11] Patent Number: 5,182,492

[45] Date of Patent: Jan. 26, 1993

[54] ELECTRON BEAM SHAPING APERTURE IN LOW VOLTAGE, FIELD-FREE REGION OF ELECTRON GUN

[75] Inventor: Hsing-Yao Chen, Barrington, Ill.

[73] Assignee: Chunghwa Picture Tubes, Ltd., Taoyuan, Taiwan

[21] Appl. No.: 885,880

[22] Filed: May 20, 1992

[51] Int. Cl.[5] ..... H01J 29/46; H01J 29/56

[52] U.S. Cl. ..... 315/14; 313/414

[58] Field of Search ..... 315/14, 15; 313/414

[56] References Cited

U.S. PATENT DOCUMENTS

| | | | |
|---|---|---|---|
| 2,070,319 | 2/1937 | Rudenbeg | 250/27.5 |
| 2,072,957 | 3/1937 | McGee | 250/27.5 |
| 2,111,941 | 3/1938 | Schlesinger | 250/27.5 |
| 2,128,581 | 8/1938 | Garrdner | 250/27.5 |
| 2,135,941 | 11/1938 | Hirmann | 250/27.5 |
| 2,185,590 | 1/1940 | Epstein | 250/155 |
| 2,202,631 | 5/1940 | Headrick | 250/163 |
| 2,209,159 | 7/1940 | Gorlich et al. | 250/27.5 |
| 2,213,688 | 9/1940 | Broadway et al. | 250/160 |
| 2,217,168 | 10/1940 | Hefele et al. | 250/27 |
| 2,229,766 | 1/1941 | Nicoll et al. | 250/27 |
| 2,260,313 | 10/1941 | Gray | 250/27 |
| 2,888,606 | 5/1959 | Beam | 315/16 |
| 3,798,478 | 3/1974 | Say | 313/70 |
| 3,887,830 | 6/1975 | Spencer | 313/443 |
| 3,919,588 | 11/1975 | Parks et al. | 315/14 |
| 3,928,784 | 12/1975 | Weijland | 313/389 |
| 4,009,410 | 2/1977 | Pommier et al. | 313/411 |
| 4,218,635 | 8/1980 | Bedard et al. | 315/17 |
| 4,268,777 | 5/1981 | van Roosmalen | 315/1 |
| 4,388,556 | 6/1983 | Rao | 315/14 |
| 4,467,243 | 8/1984 | Fukushima et al. | 313/448 |
| 4,540,916 | 9/1985 | Maruyama et al. | 315/16 |
| 4,549,113 | 10/1985 | Rao | 315/14 |
| 4,620,133 | 10/1986 | Morrell et al. | 315/15 |
| 4,628,224 | 12/1986 | Collins et al. | 313/414 |
| 4,724,359 | 2/1988 | Roussin | 315/15 |
| 4,764,704 | 8/1988 | New et al. | 313/414 |
| 4,766,344 | 8/1988 | Say | 313/414 |
| 4,825,121 | 4/1989 | Miyazaki | 313/414 |
| 4,886,998 | 12/1989 | Endo | 313/414 |
| 5,066,887 | 11/1991 | New | 313/414 |

*Primary Examiner*—Theodore M. Blum
*Attorney, Agent, or Firm*—Emrich & Dithmar

[57] ABSTRACT

Energetic electrons emitted by heated cathodes in a multi-beam color cathode ray tube (CRT) are directed to a low voltage beam forming region (BFR) of an electron gun, with the thus formed electron beams then directed through a high voltage main focus lens for focusing the beams on a display screen of the CRT. The BFR includes a $G_2$ electron having three spaced inline apertures each disposed within an essentially electrostatic field-free region and through each of which a respective electron beam passes. Each $G_2$ aperture intercepts an outer portion of an associated electron beam to provide an electron beam cross sectional shape which compensates for the asymmetric focusing effect of the main focus lens in correcting for beam spherical aberration to provide a rotationally symmetric electron beam spot on the display screen. The invention is also adapted for use in a monochrome, single electron beam CRT to provide a desired electron beam spot shape for optimum display pixel density and/or to eliminate display discontinuities and provide a smooth video image display.

28 Claims, 6 Drawing Sheets

ELECTRON BEAM SHAPING APERTURE IN LOW VOLTAGE, FIELD-FREE REGION OF ELECTRON GUN

Field of the Invention

This invention relates generally to electron guns for forming, accelerating and focusing an electron beam such as in a cathode ray tube (CRT) and is particularly directed to an arrangement for compensating for focus lens asymmetry and providing a small, circular electron beam spot on the CRT's display screen. This invention is also adapted for shaping an electron beam in a CRT to provide optimum display pixel density and/or to eliminate display discontinuities and provide a smooth video display.

BACKGROUND OF THE INVENTION

In electron beam devices such as CRTs, the preferred electron beam cross section is not always rotationally symmetric so as to produce a circular spot on the display screen. For example, in recent years color CRT electron gun designers have adopted various asymmetric lenses in their designs to improve the overall performance of the raster display. In these asymmetric lenses, a rotationally symmetric electron beam can give rise to undesired aberration due to mismatched electron lens and electron beam shapes. The designer's goal is to provide an electron beam with a desired cross sectional shape which does not produce undesired electron beam aberration.

An example of electron beam aberration caused by mismatched electron lens and electron beam shapes can be explained with reference to the sectional view of a prior art QPF electron gun 10 shown in FIG. 1. Electron gun 10 is intended for use in a color CRT and thus includes three inline cathodes 12*a*, 12*b* and 12*c*. Electron gun 10 further includes a beam forming region (BFR) 58 comprised of a $G_1$ control electrode, a $G_2$ screen electrode, and the low voltage side of a $G_3$ electrode. Electron gun 10 further includes a symmetric prefocus lens 60 comprised of the high voltage side of the $G_2$ electrode, a $G_4$ electrode and the low voltage side of a $G_5$ electrode. The three electron beams are focused on a display screen of a CRT (which are not shown in FIG. 1 for simplicity) by means of a main focus lens comprised of the high voltage side of the $G_5$ electrode and a $G_6$ electrode. A sectional view of electron gun 10 shown in FIG. 1 taken along site line 2—2 therein illustrating the high voltage side of the $G_5$ electrode is shown in FIG. 2. The $G_1$ electrode is typically maintained at zero voltage, while the $G_2$ and $G_4$ electrodes are typically coupled to a common $V_{G2}$ voltage source and the $G_3$ and $G_5$ electrodes are coupled to a common focus voltage $V_F$ source. The $G_6$ electrode is typically coupled to an accelerating, or anode, voltage $V_A$ source. Each of the three electron beams is directed through a plurality of aligned apertures in the various electrodes of electron gun 10 as the electrons proceed from cathodes 12*a*, 12*b* and 12*c* toward the CRT's display screen.

More specifically with respect to the electron gun's main focus lens 64, the low voltage side of the $G_5$ electrode includes spaced apertures 30*a*, 30*b* and 30*c* aligned with inner apertures 34*a*, 34*b* and 34*c* for passing respective electron beams. The high voltage side of the $G_5$ electrode includes a peripheral wall 66 defining an elongated, recessed portion 32 which functions as a common lens for the three electron beams. The facing low voltage side of the $G_6$ electrode includes an elongated, recessed portion 36 also forming a common lens for the three electron beams. The high voltage side of the $G_6$ electrode includes three spaced apertures 38*a*, 38*b* and 38*c* for passing respective electron beams toward the CRT's display screen.

Referring to FIG. 3, there is shown a sectional view of the electron gun 10 shown in FIG. 1 illustrating only the $G_2$, $G_5$ and $G_6$ electrodes of the electron gun for simplicity, it being understood that the remaining electrodes shown in FIG. 1 are also included in the electron gun shown partially in FIG. 3. In FIG. 3, line A—A' represents the red electron gun axis, line B—B' represents the green electron gun axis, and line C—C' represents the blue electron gun axis. As shown in FIG. 3, the three electron beams respectively transit apertures 16*a*, 16*b* and 16*c* in the $G_2$ electrode prior to passing through the main focus lens comprised of the $G_5$ and $G_6$ electrodes. The main focus lens 64 applies an asymmetric electrostatic field to the three electron beams. This asymmetric electrostatic field arises from the inline alignment of the three electron beams and the shape of the common lens portions of the $G_5$ and $G_6$ electrodes formed from facing recessed portions 32 and 36. The facing common lens portions of the $G_5$ and $G_6$ electrodes form a combined optimum tube and yoke (COTY) lens.

The effect of this asymmetrical electrostatic field and resulting forces applied to the outer electron beams as they transit the common lens portion of the $G_5$ electrode is shown in the upper portion of FIG. 3. It can be seen that electron beam rays crossover the axis of each of the electron guns prior to being incident upon a phosphor coating 42 deposited on an inner surface of the CRT's display screen 40. This electron ray crossover is effected primarily by the main focus lens 64 of the electron gun 10. The two outer electron beams form left and right beam spots 52 and 54, while the center electron beam forms a center beam spot 50 on phosphor coating 42. As shown in FIG. 3, the outer electron beam rays in the two outer electron beams undergo a greater focusing effect by the main focus lens 64 than the inner rays (those rays disposed closer to the axis B—B' of the center electron gun). Outer electron beam rays in each of these outer beams are deflected a distance $r_1$ after crossover, while inner rays are deflected a distance $r_0$ from the respective center axes A—A' and C—C' of the two outer electron guns, where $r_1 > r_0$. The increased inner deflection of the outer rays in the two outer electron beams arises from the asymmetric electrostatic field applied to the electron beams.

The result of the application of this asymmetrical electrostatic focusing field on the two outer electron beams is more clearly shown in FIG. 3*a* which is a sectional view taken along site line 3*a*—3*a* in FIG. 3. The axis of the center electron beam is shown as element 44, while the axes of the left and right outer electron beams are respectively shown as elements 46 and 48. From the figure, it can be seen that the over-focusing of the outer rays in the two outer electron beams prior to crossover gives rise to asymmetrical outer electron beam spots 52 and 54. Outer electron beam spot 52 includes an inward directed extension 52*a* caused by over-focusing of the outer rays as the electron beam transits the main focus lens of the electron gun. Similarly, the right electron beam spot 54 includes an inwardly directed extension 54*a* also caused by overfocusing of the outer rays as the electron beam transits the main focus lens. Inward extensions 52*a* and 54*a*, which are sometimes referred to as a beam spot tail or flare, appear as spherical aberration on the CRT's display screen and degrade video image quality. This electron beam spot tail also appears in the center beam spot when the center beam is deflected off-axis.

An obvious approach to correcting for this electron beam spherical aberration is to intercept the beam with a properly shaped aperture in an electrode of the gun. However, mechanically intercepting the electron beam by means of a physical obstruction in the beam path gives rise to other problems. For example, an electrostatic field in the region where the beam is intercepted and shaped will give rise to an additional asymmetric focusing effect imposed upon the beam which may cause some spherical aberration and operate to defeat the purpose of intercepting the beam. In addition, secondary electrons will be emitted by the beam intercepting grid. These secondary electrons are directed toward the display screen by the electrostatic field in the vicinity of the beam intercepting grid causing loss of contrast and/or loss of purity in a color CRT. A third problem also arises from the energetic electrons incident upon the beam intercepting grid about a beam shaping aperture. Because the electrons are intercepted in a high voltage region of the electron gun and have a high kinetic energy (an electron gun typically has a focus voltage of a few thousand volts), the intercepted high energy electrons release their kinetic energy at the aperture region causing a substantial increase in the temperature of the beam intercepting grid which in some cases may become vaporized before this energy can be dissipated.

The present invention addresses the aforementioned limitations of the prior art by compensating for the asymmetric electrostatic field of a main lens in an electron gun and correcting for the resulting electron beam spherical aberration in a color CRT to provide a small, circular beam spot on the CRT's display screen. The present invention corrects the spherical aberration in an electron beam arising from a main lens asymmetric electrostatic focus field by providing a compensated electron beam cross sectional shape as the beam enters the main lens to provide improved electron beam spot performance. The present invention also may be used to shape an electron beam in a monochrome CRT to provide optimum display pixel density and/or to eliminate display discontinuities and provide a smooth video display.

Objects and Summary of the Invention

Accordingly, it is an object of the present invention to provide an electron beam in a CRT having a small, well defined, circular spot on the CRT's display screen for improved video image quality.

It is another object of the present invention to provide an arrangement in a low voltage beam forming region of an electron gun which intercepts and shapes an electron beam to compensate for asymmetric focus effect on the beam by the electron gun's focus lens.

Yet another object of the present invention is to provide an essentially electrostatic field-free region in the beam forming region of an electron beam lens with a small, shaped aperture for shaping electron beam cross section to compensate for asymmetric focusing of the beam in forming a circular electron beam spot on the CRT's display screen with minimum energy dissipation in the form of heat and the elimination of secondary electron emissions and associated degradation of video image quality.

A further object of the present invention is to provide an energy efficient, shaped aperture arrangement for compensating for spherical aberration in a multi-electron beam color CRT.

A still further object of the present invention is to match low voltage beam forming and high voltage beam focus portions of an electron gun for minimizing spherical aberration and providing an improved image on the screen of a color CRT.

Another object of the present invention is to provide a $G_2$ grid in a color CRT with shaped apertures for compensating for spherical aberration of the CRT's beam focus lens and providing a rotationally symmetric beam incident upon the CRT's display screen.

Still another object of the present invention is to shape an electron beam in a monochrome CRT to provide optimum display pixel density and/or to eliminate display discontinuities and provide a smooth video display.

These objects of the present invention are achieved and the disadvantages of the prior art are eliminated by a lens for focusing a center electron beam and two outer electron beams to respective spots on a display screen, wherein each of the electron beams is comprised of energetic electrons emitted by a source along a respective axis and wherein the electron beams are focused by a main lens and accelerated by an anode voltage $V_A$ toward the display screen, the lens comprising: a low voltage beam forming arrangement proximally disposed relative to the source of electrons for forming the energetic electrons into the center and two outer electron beams, the beam forming arrangement including a relatively electrostatic field-free region on the respective axes of each of the electron beams; a high voltage asymmetric focusing lens disposed intermediate the beam forming arrangement and the display screen for focusing each of the electron beams to a respective spot on the display screen, wherein the asymmetric focusing lens imposes an asymmetric electrostatic field on the electron beams giving rise to electron beam spot distortion on the display screen; and two outer beam shaping apertures in the beam forming arrangement, wherein each beam shaping aperture is disposed on a respective axis of an outer electron beam in a relatively electrostatic field-free region for intercepting a peripheral lateral portion of an associated outer electron beam and removing electrons from an outer portion of the beam in reducing electron beam spot distortion on the display screen.

A beam shaping aperture in accordance with the present invention includes an inner beam intercepting aperture disposed intermediate a pair of cylindrically shaped, recessed portions in facing surfaces of a charged electrode in the electron gun. The recessed portions are in mutual alignment along an electron beam axis and form a substantially electrostatic field-free region at the beam intercepting aperture. The beam intercepting aperture is asymmetrically shaped and disposed about the electron beam axis so as to intercept peripheral electrons in a lateral portion of the beam in forming the beam cross section in a desired shape. The cross sectional shape of the electron beam is formed by the beam intercepting aperture so as to compensate for an asymmetric electrostatic focus field applied to the beam by the CRT's focus lens prior to incidence of the beam on the CRT's display screen. The asymmetrical shape and positioning of the beam intercepting aperture on the beam axis removes those outer electrons from the beam which are typically over-focused by the asymmetric focus lens so as to minimize beam spherical aberration and provide a circular electron beam spot centered on the beam axis. By locating the beam intercepting aperture in an essentially electrostatic field-free region, the beam intercepting aperture does not function as a focus element and thus does not give rise to beam spot aberration. In addition, by locating the beam intercepting aperture in the low voltage beam forming region of the CRT, the relatively low energy electrons incident upon the apertured electrode are less likely to produce secondary electrons which degrade video image quality. By locating the electron beam intercepting aperture in the relatively low voltage BFR, the intercepted electrons have a reduced kinetic energy so as to minimize electrode thermal dissipation.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG is a sectional view shown partially in schematic diagram form of a prior art inline electron gun taken along the XZ plane for use in a color CRT.

DETAILED DESCRIPTION OF THE PREFERRED EMBODIMENTS

Figure 4:
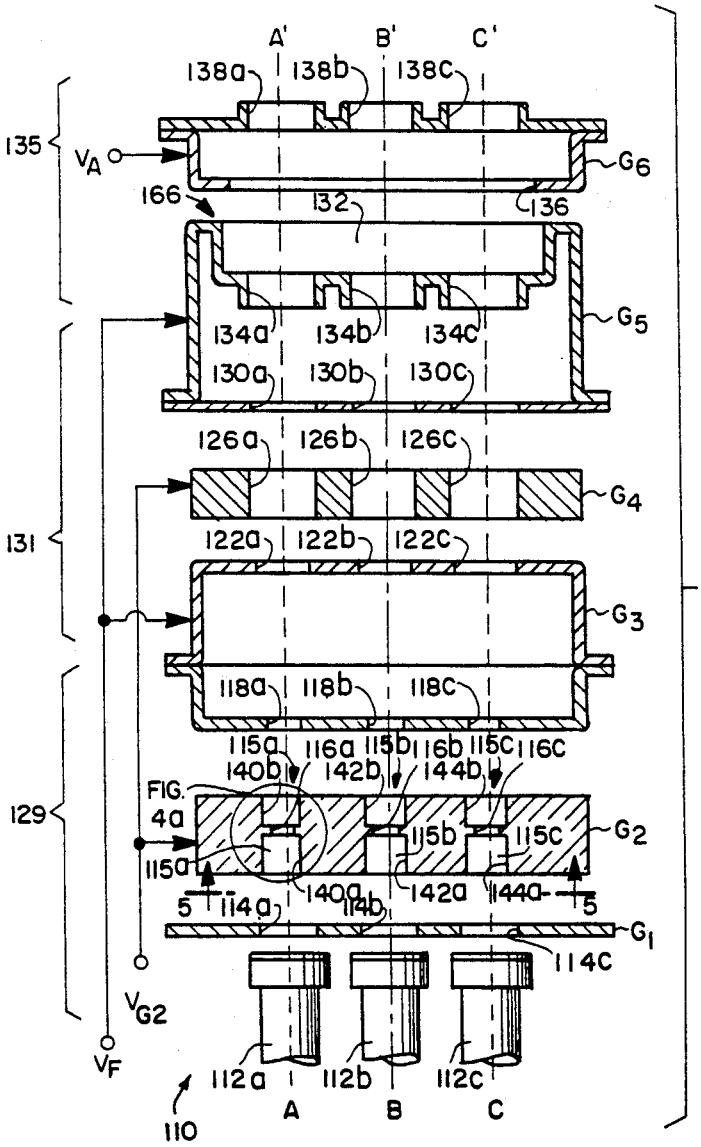
FIG. 4 is a sectional view shown partially in schematic diagram form of an electron gun with three electron beam shaping apertures taken along the XZ plane in a low voltage, essentially electrostatic field-free region of the electron gun in accordance with the principles of the present invention.

Referring to FIG. 4, there is shown a sectional view shown partially in schematic diagram form of an electron gun 110 taken along the XZ plane incorporating a plurality of spaced beam shaping apertures in accordance with the principles of the present invention. Electron gun 110 includes three equally spaced co-planar cathodes 112*a*, 112*b* and 112*c* (one for each beam), a $G_1$ control electrode, a $G_2$ screen electrode, and $G_3$, $G_4$, $G_5$ and $G_6$ electrodes. The electrodes are spaced in the recited order from the cathodes 112*a*, 112*b* and 112*c* and are attached to a conventional support arrangement such as a pair of glass rods, which are not shown in the figure for simplicity. The specific number and arrangement of electrodes in FIG. 4 is used merely to describe one example of an electron gun in which the electron beam shaping apertures of the present invention may be used. However, the present invention may be used with virtually any type of asymmetric focusing lens for compensating for electron beam spherical aberration. In addition, while the present invention is described and shown in FIG. 4 as incorporated in a multi-beam electron gun 110 for use in a color CRT, the present invention is not limited to use in a multi-beam electron gun, but is equally useful in a single beam electron gun such as used in a monochrome, or black and white, CRT as described below.

Cathodes 112*a*, 112*b* and 112*c*, the $G_1$ control electrode, the $G_2$ screen electrode, and the low voltage side of the $G_3$ electrode facing the $G_2$ electrode comprise a beam forming region (BFR) 129 of the electron gun 110. The high voltage side of the $G_3$ electrode, the $G_4$ electrode, and the facing portion of the $G_5$ electrode comprise a symmetric prefocus lens 131 of the electron gun 110. The $G_6$ electrode and a facing portion of the $G_5$ electrode form the main focus lens 135 of electron gun 110.

Various voltages are provided to the various electrodes as indicated in FIG. 4. For example, a voltage $V_{G2}$ is provided to the $G_2$ and $G_4$ electrodes, while a focus voltage $V_F$ is provided to the $G_3$ and $G_5$ electrodes. An accelerating voltage $V_A$ is provided to the $G_6$ electrode, while the $G_1$ control electrode is typically maintained at a negative potential, or voltage, relative to the cathodes and serves to control electron beam intensity in response to the application of a video signal thereto, or to the cathodes. The accelerating, or anode, voltage $V_A$ is substantially higher than the focus voltage $V_F$ and serves to accelerate the electrons toward a display screen (not shown in the figure for simplicity) having a phosphor coating on the inner surface thereof. $V_F$ is typically 20–40% of the anode voltage $V_A$.

Electrons emitted by cathodes 112*a*, 112*b* and 112*c* are directed through apertures 114*a*, 114*b* and 114*c*, respectively, in the $G_1$ control electrode and thence through respective beam shaping apertures 115*a*, 115*b* and 115*c* in the $G_2$ screen electrode. After transiting the $G_2$ electrode, the three electron beams respectively pass through first, second and third apertures 118*a*, 118*b* and 118*c* in the low voltage side of the $G_3$ electrode and thence through apertures 122*a*, 122*b* and 122*c* in the high voltage side of the $G_3$ electrode. The $G_4$ electrode similarly includes three spaced apertures 126*a*, 126*b* and 126*c* through each of which a respective electron beam passes. The electron beams are then directed through the $G_5$ electrode, with the two outer electron beams transiting aligned outer pairs of apertures 130*a*, 134*a* and 130*c*, 134*c*, respectively, while the center electron beam passes through center aligned apertures 130*b* and 134*b*. Apertures 134*a*, 134*b* and 134*c* in the $G_5$ electrode are disposed in a recessed common lens portion 132 of that electrode formed by peripheral wall 166. All three electron beams then pass through an elongated common lens aperture 136 in the low voltage side of the $G_6$ electrode and are then directed through apertures 138*a*, 138*b* and 138*c* on the high voltage side of the $G_6$ electrode. The high voltage side of the $G_5$ electrode and the $G_6$ electrode comprise the main focus lens 135 of electron gun 110 for electron beam crossover of the beam axis and for focusing each of the electron beams on the CRT's display screen (not shown in the figure for simplicity).

In accordance with the present invention, the $G_2$ electrode includes three inline, spaced beam shaping apertures 115*a*, 115*b* and 115*c*. Each of the beam shaping apertures 115*a*, 115*b* and 115*c* respectively include first outer recessed portions 140*a*, 142*a* and 144*a* facing the $G_1$ electrode. Each of the three beam shaping apertures 115*a*, 115*b* and 115*c* further includes a respective second outer recessed portion 140*b*, 142*b* and 144*b* facing the $G_3$ electrode. Each of the three beam shaping apertures 115*a*, 115*b* and 115*c* also includes an inner partition separating each pair of aligned recessed portions and defining beam intercepting apertures 116*a*, 116*b* and 116*c*. An enlarged sectional view of beam shaping aperture 115*a* is shown in FIG. 4*a*. Each pair of aligned first and second outer recessed portions are generally cylindrical in shape, are in common alignment along an associated electron beam axis, and have a diameter $d_{G2}$.

Also in accordance with the present invention, the $G_2$ electrode is provided with increased thickness $t_{G2}$. In a preferred embodiment, $t_{G2} \geqq 1.8\ d_{G2}$. In a preferred embodiment $300V < V_{G2} < 0.12\ V_A$, where $V_{G2}$ is the voltage applied to the $G_2$ and $G_4$ electrodes and $V_A$ is the anode voltage. The $G_1$ electrode generally serves to control electrons emitted from the cathodes and direct them in the general direction of the CRT's display screen. In addition to controlling electron beam intensity and shaping the electron beam in a desired cross section, the $G_2$ electrode also frequently serves to form a first crossover of the electron beam along its axis.

Figure 4A:
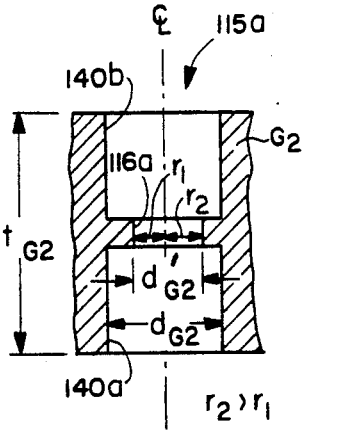
FIG. 4*a* is an enlarged view of a portion of the $G_2$ electrode in the electron gun of FIG. 4 showing a horizontal sectional view of one of the beam shaping apertures shown on the electron gun of FIG. 4 in accordance with the principles of the present invention.
Figure 5:
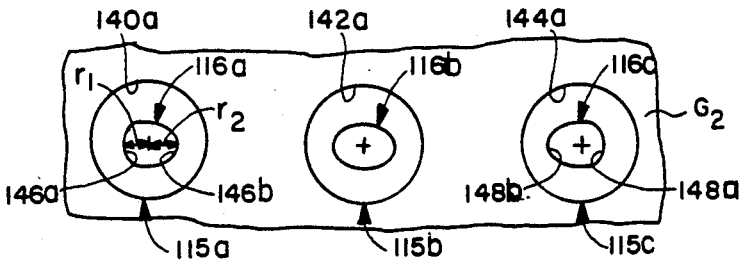
FIG. 5 is a sectional view of the electron gun of FIG. 4 taken along site line 5—5 therein showing additional details of the beam shaping apertures in the $G_2$ electrode of the electron gun.

Referring more specifically to the sectional views of FIG. 4*a* and FIG. 5, which is taken along site line 5—5 in FIG. 4, additional details of the shape and configuration of each of the three beam shaping apertures will now be described in terms of the first beam shaping aperture 115*a*. The cylindrical shaped first and second recessed portions 140*a*, 140*b* of beam shaping aperture 115*a* extend inwardly from facing surfaces of the $G_2$ electrode, with each recessed portion having a diameter $d_{G2}$. Separating the first and second recessed portions 140*a*, 140*b* is an inner partition, or wall, 119. Inner partition 119 defines the beam intercepting aperture 116*a*. While the first and second recessed portions 140*a*, 140*b* have a generally circular cross section, the beam intercepting aperture 116*a* has a somewhat irregular, curvilinear shape as shown in FIG. 5. More specifically, an inner portion 146*b* of beam intercepting aperture 116*a* disposed toward the center beam shaping aperture 115*b* extends a distance $r_2$ from the axis of the outer electron beam. Similarly, the facing outer portion 146*a* of beam intercepting aperture 116*a* extends a distance $r_1$ from the center line, or axis, of the electron beam. As shown in FIGS. 4*a* and 5, $r_2 > r_1$ and $r_1 + r_2 = d_{G2}'$. From FIG. 5, it can also be seen that the inner portion 146*b* of the beam intercepting aperture 116*a* has a smaller radius of curvature than the outer portion 146*a* of the aperture. The first outer beam intercepting aperture 116*a* is thus horizontally asymmetric about the axis of its associated electron beam, with the intercepting aperture extending further inward, or toward the electron gun centerline, than outward from the electron beam axis. The second outer beam intercepting aperture 116*c* also has associated outer and inner portions 148*a* and 148*b*, with the inner aperture portion spaced farther from the beam axis than the facing outer aperture portion. The horizontal asymmetry of each of the outer beam intercepting apertures 116*a*, 116*c* about the axis of its associated electron beam allows each of these apertures to intercept outer rays in the two outer electron beams for removing outer electrons from respective lateral portions of these two beams. In this manner, each beam intercepting aperture forms its associated electron beam cross section to compensate for the horizontal asymmetric electrostatic field of the focus lens portion of the electron gun. In a preferred embodiment, the horizontal diameter $d_{G2}'$ of the two outer beam intercepting apertures 116*a*, 116*c* is 10–50% of the diameter $d_{G2}$ of the first and second outer recessed portions of these beam shaping apertures, or $0.1\ d_{G2} \leqq d_{G2}' \leqq 0.5\ d_{G2}$.

Figure 4B:
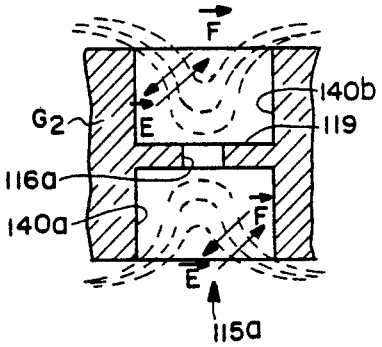
FIG. 4*b* is a vertical sectional view of the portion of the $G_2$ electrode shown in FIG. 4*a* illustrating the electrostatic field and forces applied to an electron beam transiting the beam shaping aperture.

Referring to FIG. 4*b*, there is shown a sectional view of the first beam shaping aperture 115*a* illustrating the electrostatic fields and forces applied to the electrons in the $G_2$ screen electrode in the beam forming region 129 of electron gun 110. Equipotential lines are shown in dotted-line form adjacent beam shaping aperture 115*a* in the $G_2$ electrode. From the figure, it can be seen that the facing recessed portions 140*a* and 140*b* of the $G_2$ screen electrode adjacent beam intercepting aperture 116*a* form equipotential lines which bend inwardly toward the beam intercepting aperture. Because the thickness of the $G_2$ screen electrode is such that $t_{G2} \geqq 1.8\ d_{G2}$, the equipotential lines are essentially zero in the immediate vicinity of beam intercepting aperture 116*a*. In a preferred embodiment, $t_{G2} \geqq 0.54$–$1.44$ mm and $d_{G2} = 0.3$–$0.8$ mm. The electrostatic field, represented by the field vector $\vec{E}$, applies a force represented by the force vector $\vec{F}$ to an electron, where $\vec{F} = -e\vec{E}$, and where "e" is the charge of an electron. An electrostatic field is formed between two charged electrodes, where $G_1$ is operated at a negative potential relative to the cathode, while the $G_2$ voltage is preferably maintained at 300V to $0.12V_A$, and $G_3$ is preferably maintained at the focus voltage $V_F$ of approximately 7 kV. A lateral portion of the outer periphery of the electron beam disposed away from the center electron beam strikes the outer portion of the beam intercepting aperture 116*a* to cut off the outer periphery of the electron beam. This is shown in the sectional view of FIG. 6*a* of beam shaping aperture 115*a* where electron beam rays are shown in dotted-line form passing through the beam shaping aperture. Outermost electron beam ray 154 will be intercepted by that portion of partition 119 defining an outer portion of beam intercepting aperture 116*a*. This limits the outer dimensions of the electron beam as the beam transits the $G_2$ screen electrode and proceeds toward the $G_3$ electrode. As shown by the electrostatic field and force lines in FIG. 4*b*, the low voltage side of the $G_2$ screen electrode (facing the $G_1$ electrode) operates as a diverging lens, while the high voltage side of the $G_2$ electrode adjacent the $G_3$ electrode functions as a converging lens for the electron beam rays. Outer beam shaping aperture 115*c* similarly includes an asymmetric beam intercepting aperture 116*c* for intercepting and removing outer lateral peripheral rays from the electron beam for shaping the outer electron beam to match the asymmetrical electrostatic field of the focus lens of the electron gun, as described above.

Figure 1:
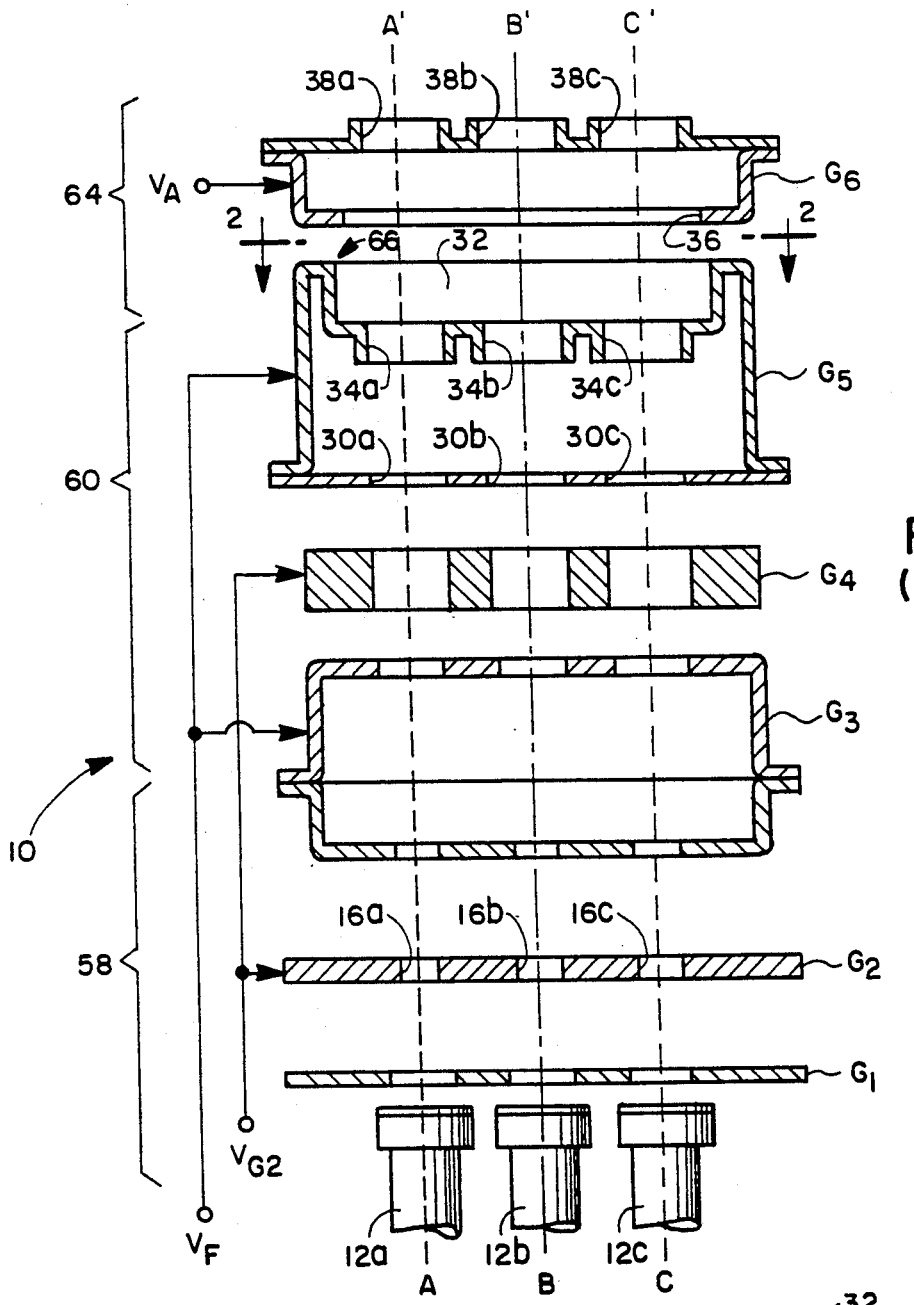
FIG. 1 (PRIOR ART)
Figure 2:
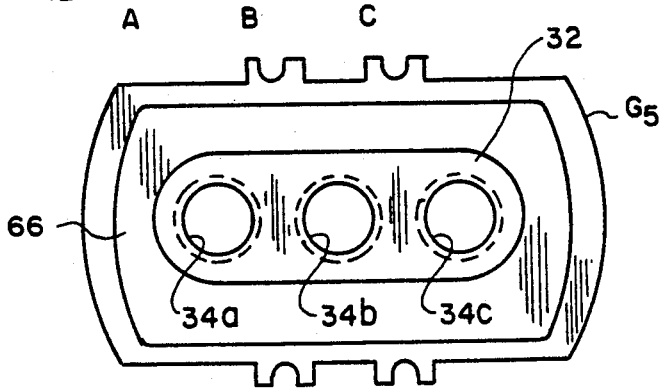
FIG. 2 (PRIOR ART)
FIG. 2 is a sectional view of the electron gun of FIG. 1 taken along site line 2—2 therein.
Figure 3:
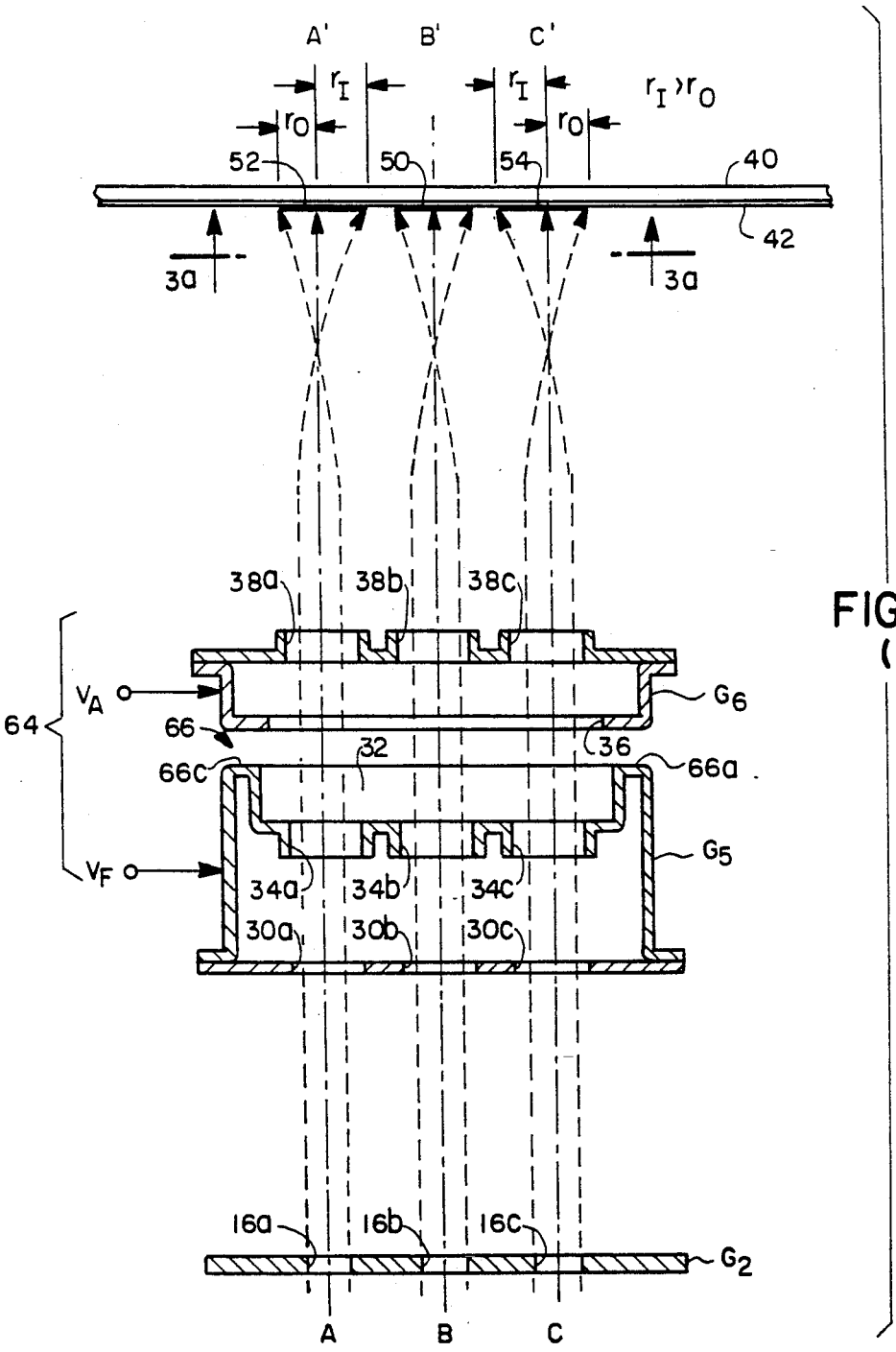
FIG. 3 (PRIOR ART)
FIG. 3 is a sectional view of the electron gun of FIG. 1 taken along the XZ plane showing only the $G_2$, $G_4$ and $G_5$ electrodes for simplicity as well as the focusing of three electron beams on the display screen of a prior art CRT.
Figure 3A:
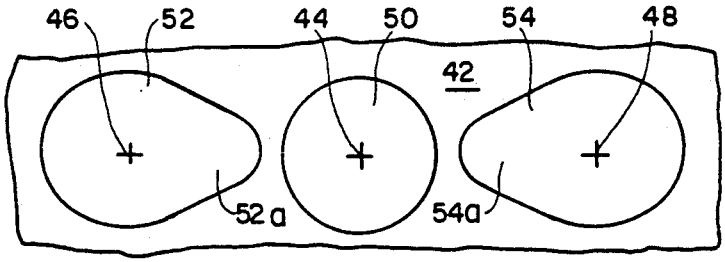
FIG. 3a (PRIOR ART)
FIG. 3*a* is a sectional view of the electron gun of FIG. 3 taken along site line 3*a*—3*a* therein showing the relative position and shape of the three electron beam spots on the CRT's display screen.
Figure 6:
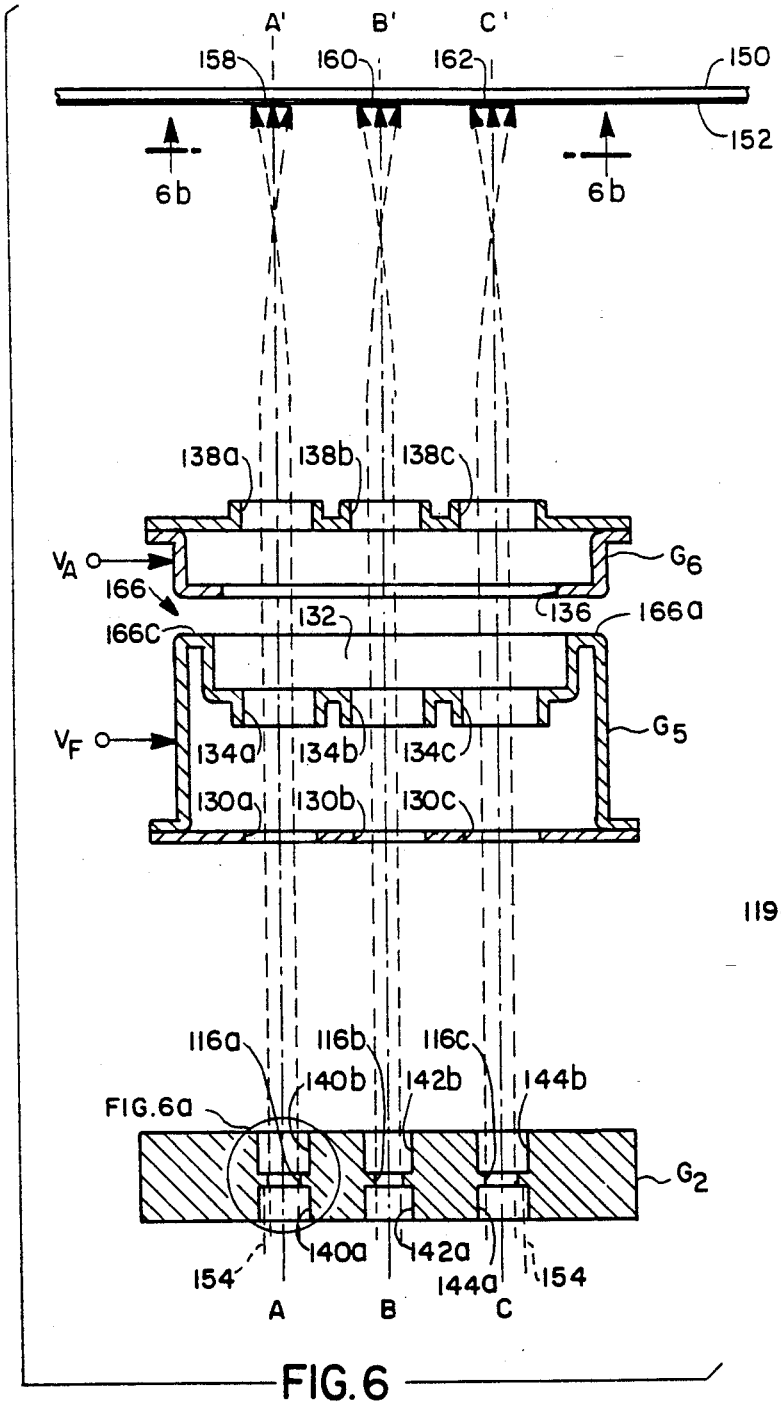
FIG. 6 is a partial sectional view of the electron gun of FIG. 4 taken along the XZ plane showing only the $G_2$, $G_4$ and $G_5$ electrodes as well as the three electron beams directed through these electrodes and onto the display screen of a CRT in accordance with the present invention.
Figure 6A:
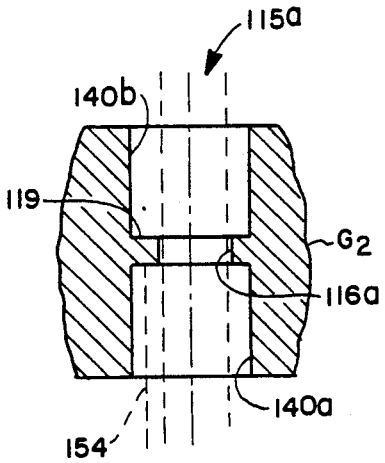
FIG. 6*a* is an enlarged view of a portion of the $G_2$ electrode shown in the electron gun of FIG. 6 illustrating additional details of a beam shaping aperture in accordance with the present invention through which an electron beam is directed.
Figure 6B:
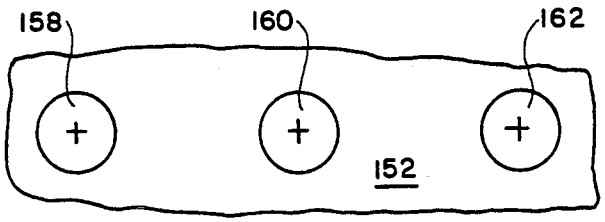
FIG. 6*b* is a sectional view of the electron gun of FIG. 6 taken along site line 6*b*—6*b* therein illustrating the relative location and shape of three electron beam spots on the CRT's display screen in accordance with the present invention.

FIG. 6 is a sectional view of the electron gun of FIG. 4 taken along the XZ plane showing only the $G_2$, $G_5$ and $G_6$ electrodes for simplicity as well as the three electron beams directed through these electrodes and onto a display screen. FIG. 6 illustrates the manner in which the beam shaping apertures in the $G_2$ electrode correct for focus lens electrostatic field asymmetry to provide a circular beam spot on the phosphor coating 152 of the CRT's display screen 150. The first and second outer beam intercepting apertures 116*a* and 116*c* cut off the outer lateral periphery of each of the two outer electron beams to eliminate outer peripheral electron beam rays 154. By cutting off outer lateral portions of the two outer electron beams, over-focusing of the outer rays of these beams (as shown in the prior art arrangement of FIG. 3) is eliminated to provide circular beam spots 158, 160 and 162 on the CRT's display screen 150 as shown in the sectional view of FIG. 6*b* taken along site line 6*b*—6*b* in FIG. 6. This can also been seen in FIG. 6, where the inner and outer rays of each of the three electron beams are deflected symmetrically relative to each electron beam axis to provide three electron beam spots 158, 160 and 162 each symmetrically disposed about a beam axis on the phosphor coating 152 on the CRT's display screen 150. The horizontally elongated beam intercepting aperture 116*b* of the center beam shaping aperture 115*b* provides a horizontally aligned, generally elliptically shaped center electron beam cross section to the main focus lens 135 to compensate for its horizontally asymmetric electrostatic focus field and provide a small, circular center electron beam spot on the CRT's display screen.

Figure 7:
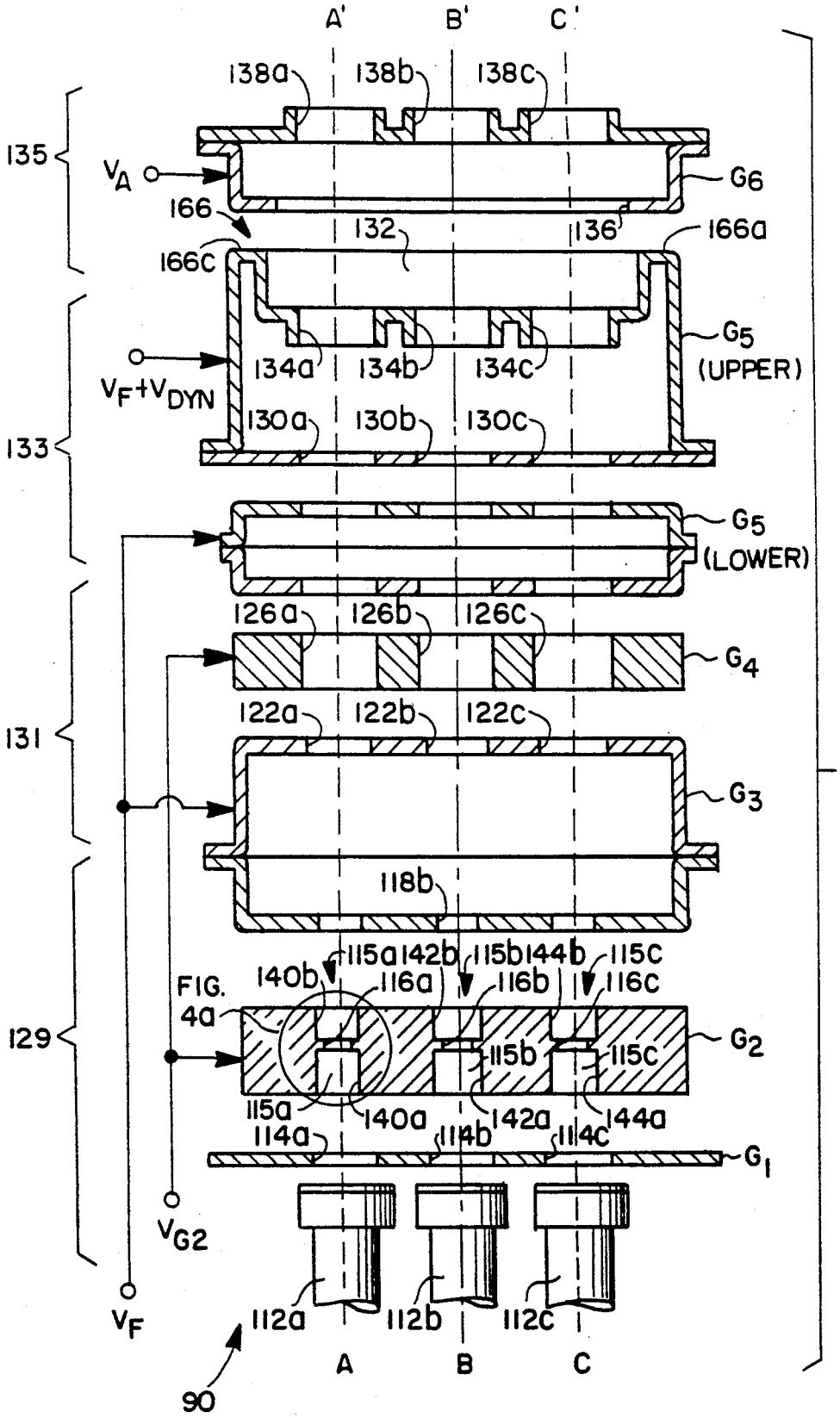
FIG. 7 is a sectional view shown partially in schematic diagram form of an electron gun having a dynamic quadrupole with three electron beam shaping apertures taken along the XZ plane in a low voltage, essentially electrostatic field-free region of the electron gun in accordance with another embodiment of the present invention.

Referring to FIG. 7, there is shown a sectional view shown partially in schematic diagram form of an electron gun 90 taken along the XZ plane incorporating electron beam shaping apertures in accordance with another embodiment of the present invention. Electron gun 90 shown in FIG. 7 is similar to the electron gun 110 shown in FIG. 4 with common identifying numbers used to designate common elements performing the same function in both electron guns, with the exception that the electron gun of FIG. 7 includes a dynamic quadrupole focusing arrangement. Thus, the electron gun of FIG. 7 includes a beam forming region 129 comprised of cathodes 112*a*, 112*b* and 112*c*, a $G_1$ control electrode, a $G_2$ screen electrode, and a low voltage side of a $G_3$ electrode. As in the previous embodiment, the $G_2$ screen electrode includes three spaced, inline beam shaping apertures 115*a*, 115*b* and 115*c*. Electron gun 90 further includes a symmetric prefocus lens 131 comprised of a high voltage side of the $G_3$ electrode, a $G_4$ electrode and a low voltage side of a $G_5$ (LOWER) electrode. The $G_5$ (LOWER) electrode includes three spaced pairs of apertures in facing sides thereof through which a respective electron beam is directed. Electron gun 90 further includes a main focus lens 135 comprised of a high voltage side of a $G_5$ (UPPER) electrode and a $G_6$ electrode. A $V_{G2}$ voltage is applied to the $G_2$ and $G_4$ electrodes, while a focus voltage $V_F$ is provided to the $G_3$ and $G_5$ (LOWER) electrodes. An anode voltage $V_A$ is provided to the $G_6$ electrode. In addition to the focus voltage $V_F$, a dynamic voltage $V_{DYN}$ is applied to the $G_5$ (UPPER) electrode to form a dynamic quadrupole 133 in electron gun 90. Co-pending application Ser. No. 783,196, filed in the name of the present inventor and assigned to the assignee of the present application, describes a dynamic quadrupole main lens such as incorporated in the electron gun 90 of FIG. 7. The disclosure of the aforementioned co-pending application Ser. No. 783,196 is hereby incorporated in the present application by reference. The three beam shaping apertures 115*a*, 115*b* and 115*c* form the three electron beams to compensate for the asymmetric dynamic quadrupole main lens electrostatic field as previously described to provide spherical aberration corrected electron beam spots on the CRT's display screen.

Figure 8:
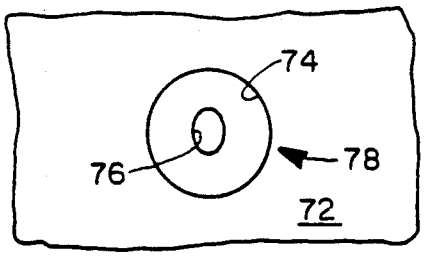
FIG. 8 is an elevation view of an electrode having a vertically elongated beam shaping aperture for use in a monochrome CRT in accordance with another embodiment of the present invention.

The present invention may also be used to shape an electron beam to eliminate horizontal scan line discontinuities in the video display as the electron beam is displaced over the CRT's display screen in a raster-like manner. Referring to FIG. 8, there is shown an elevation view of a portion of an electrode 72 incorporating a beam shaping aperture 78 in accordance with this embodiment of the present invention. Beam shaping aperture 78 includes a beam intercepting aperture 76 disposed within a recessed portion 74 in electrode 72. A similar recessed portion not shown in the figure is disposed on the opposed side of the beam intercepting aperture 76 so as to provide an essentially electrostatic field-free region at the beam intercepting aperture. Beam intercepting aperture 76 is generally oval-shaped, having a vertically oriented longitudinal axis. This beam intercepting aperture shape provides a vertically elongated electron beam spot on the CRT's display screen to ensure overlapping of adjacent horizontal sweep lines and the elimination of discontinuities in the form of horizontal dark lines across the display screen.

Figure 9A:
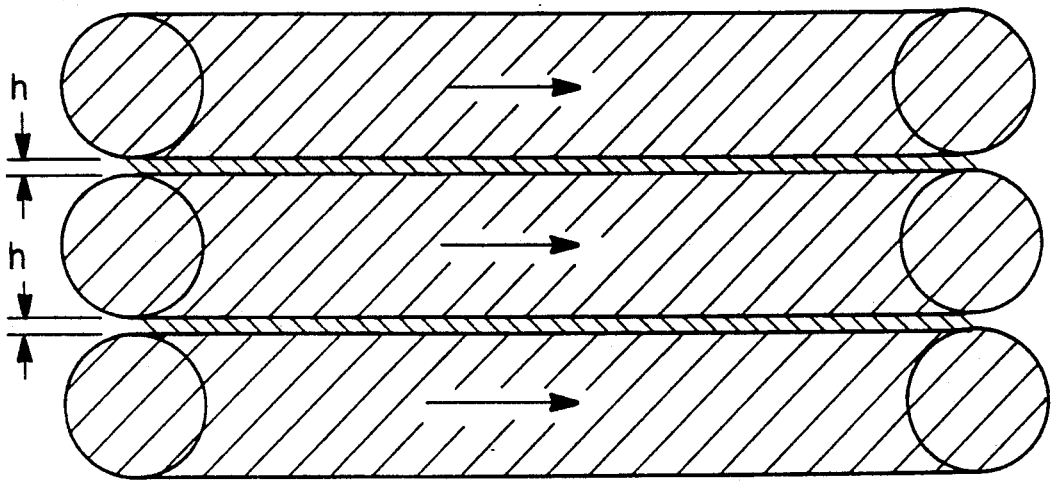
FIG. 9a (PRIOR ART)
FIGS. 9*a* and 9*b* are elevation views of a portion of a display screen of a monochrome CRT respectively illustrating discontinuities on a prior art display screen and the manner in which those discontinuities are eliminated by means of the beam shaping aperture of FIG. 8 in accordance with the present invention.

These horizontal scan line discontinuities extending across the display screen are shown in the prior art illustration of FIG. 9*a* which is a simplified schematic diagram of three adjacent horizontal electron beam scan lines. As shown in the figure, a vertical distance "h" separates adjacent, vertically spaced horizontal scan lines resulting in dark line discontinuities across the video display. As shown in FIG. 9*a*, the electron beam spot is generally circular.

Figure 9B:
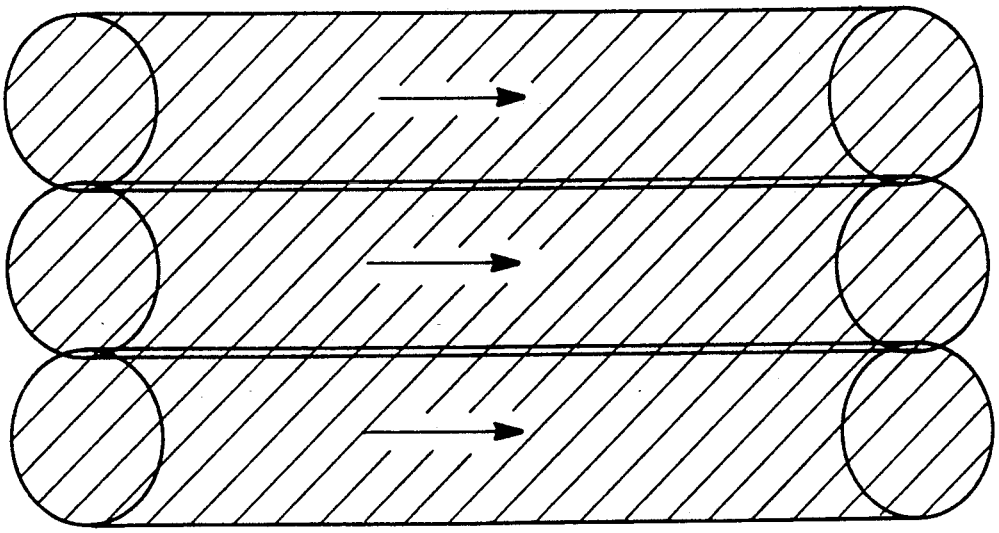

Referring to FIG. 9*b*, there is shown in simplified diagram form a shaped electron beam spot being traced over a CRT display screen in which the discontinuities in the video display have been eliminated in accordance with the present invention. A beam shaping aperture 78 including a generally vertically elongated, oval-shaped beam intercepting aperture 76 as shown in FIG. 8 is used to provide similarly shaped electron beam spot on the display screen as shown in FIG. 9*b*. The vertically elongated, oval-shaped electron beam spot shown being traced from left to right in forming a plurality of scan lines on the display screen provides vertical overlapping of adjacent horizontal scan lines which eliminates discontinuities, or gaps, between adjacent electron beam scan lines. By thus selectively shaping the electron beam cross section by means of a beam shaping aperture in accordance with the present invention, video display discontinuities may be eliminated and a smooth video image display realized. In addition, the electron beam may be shaped to accommodate vertically elongated pixels and the associated increase in horizontal pixel density such as employed in some computer terminals for higher image resolution.

There has thus been shown an electron gun incorporating a beam shaping aperture in a low voltage, field-free region of the gun which provides an electron beam cross sectional shape which compensates for a horizontally asymmetric electrostatic focusing field of a focus lens in the gun to provide a rotationally symmetric, small beam spot on a CRT display screen. The beam shaping aperture includes recessed outer cylindrical slots extending inward from facing surfaces of a charged electrode in the low voltage beam forming region of the electron gun. The cylindrical slots are aligned along the electron beam axis and are separated by a thin partition which defines a smaller, asymmetric beam intercepting aperture for removing peripheral electrons from the beam and providing the beam with a desired cross sectional shape for minimizing beam spherical aberration caused by the asymmetric electrostatic field of the gun's focus lens. By locating the beam intercepting aperture in a substantially electrostatic field-free region, the beam intercepting aperture does not impose a focus lens effect on the beam and any associated aberration effects are thus eliminated. By positioning the beam intercepting aperture in an electrode in the low voltage beam forming region of the electron gun (preferably in the $G_2$ screen electrode), secondary electrons are substantially prevented from reaching the display screen and power loss and heat problems are reduced. The asymmetric shape of the beam intercepting aperture is preferably matched to the asymmetric electrostatic focus field so as to compensate for beam spherical aberration and defocusing caused by the focus lens.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A lens for focusing a center electron beam and two outer electron beams to respective spots on a display screen, wherein each of said electron beams is comprised of energetic electrons emitted by a source along a respective axis and wherein said electron beams are focused by a main lens and accelerated by an anode voltage $V_A$ toward said display screen, said lens comprising:

low voltage beam forming means proximally disposed relative to the source of electrons for forming the energetic electrons into said center and two outer electron beams, said beam forming means including a charged electrode having a thickness to along used axes for providing a relatively electrostatic field-free region on the respective axes of each of said electron beams;

high voltage asymmetric focusing means disposed intermediate said beam forming means and the display screen for focusing each of said electron beams to a respective spot on the display screen, wherein said asymmetric focusing means imposes an asymmetric electrostatic field on said electron beams giving rise to electron beam spot distortion on the display screen; and means for defining two outer beam shaping apertures in said charged electrode, wherein each beam shaping aperture is disposed on a respective axis of an outer electron beam in said relatively electrostatic field-free region for intercepting a peripheral lateral portion of an associated outer electron beam and removing electrons form an outer portion of said beam in compensating for said asymmetric electrostatic field and reducing electron beam spot distortion on the display screen, wherein said beam shaping aperture has a curvilinear, non-circular shape and a horizontal width d, where $t>d$.

2. The lens of claim 1 wherein said charged electrode comprises a $G_2$ electrode.

3. The lens of claim 2 wherein said $G_2$ electrode includes first and second pairs of aligned recessed portions extending inwardly from opposed facing surfaces of said $G_2$ electrode and wherein each of said first and second pairs of recessed portions is aligned along the axis of one of said outer electron beams and wherein said $G_2$ electrode further includes first and second thin walls separating paired first and second recessed portions and defining respective beam intercepting apertures.

4. The lens of claim e wherein each of said beam intercepting apertures includes outer and inner facing arc-like lateral portions respectively disposed $r_1$ and $r_2$ from the axis of its associated electron beam, where $r_2>r_1$, for intercepting and removing outer electrons from a lateral portion of said electron beam.

5. The lens of claim 4 wherein said outer arc-like lateral portion of each beam intercepting aperture has a larger radius of curvature than its associated inner arc-like lateral portion.

6. The lens of claim 5 wherein said $G_2$ electrode has a thickness $t_{G2}$ along said axis and each of said first and second recessed portions is generally circular having a diameter $d_{G2}$, where $t_{G2} > 1.8\ d_{G2}$.

7. The lens of claim 6 wherein $t_{G2} \geqq 0.54-1.44$ mm and $d_{G2} = 0.3-0.8$ mm.

8. The lens of claim 7 wherein $r_1 + r_2 = d_{G2}$ 'and $d_{G2}' = 10-50\%\ d_{G2}$.

9. The lens of claim 8 wherein said $G_2$ electrode is maintained at a potential of $V_{G2}$, where $300V \leqq 0.12\ V_A$, where $V_A$ is the anode voltage.

10. The lens of claim 9 wherein the source of electrons includes three cathodes and said beam forming means further includes a charged $G_1$ electrode disposed intermediate said cathodes and said $G_2$ electrode.

11. An electron gun for a color cathode ray tube wherein a plurality of inline electron beams are deflected in a raster-like manner across a display screen to produce an image thereon, said electron gun comprising:

cathode means for generating energetic electrons;

low voltage beam forming means disposed adjacent said cathode mans for receiving said energetic electrons and forming each of the electron beams along a respective axis and directing the electron beams toward the display screen, said beam forming means including a charged electrode having a thickness t along said axes for forming a relatively electrostatic field-free region on the respective axes of each of said electron beams;

high voltage asymmetric focusing means disposed intermediate said beam forming means and the display screen for receiving the electron beams and forming an electron beam crossover on each electron beam axis in focusing said electron beam on the display screen, wherein said high voltage asymmetric focusing means imposes an asymmetric electrostatic field on said electron beam giving rise to electron beam spot distortion on the display screen; and means for defining a plurality of beam shaping apertures each disposed on a respective electron beam axis in the relatively field-free region of said low voltage beam forming means for intercepting an outer lateral portion of a respective electron beam and removing electrons from a peripheral portion of said electron beam in compensating for said asymmetric electrostatic field and reducing electron beam spot distortion on the display screen, wherein each beam shaping aperture has a curvilinear, non-circular shape and a horizontal width d, where $t > d$.

12. The electron gun of claim 11 wherein said charged electrode includes a plurality of first and second recessed portions each disposed on a respective electron beam axis and extending inwardly form opposed facing surfaces of said electrode, and wherein each of said first and second recessed portions are separated by a thin wall in said electrode defining a beam shaping aperture.

13. The electron gun of claim 12 wherein said beam shaping aperture has a curvilinear, non-circular shape and includes outer and inner facing arc-like lateral portions respectively disposed $r_1$ and $r_2$ from the electron beam axis, where $r_2 > r_1$, for intercepting and removing outer electrons from a lateral portion of said electron beam.

14. The electron gun of claim 13 wherein said outer arc-like lateral portion of said beam intercepting aperture has a larger radius of curvature than said inner arc-like lateral portion.

15. The electron gun of claim 14 wherein said charged electrode comprises a $G_2$ electrode.

16. The electron gun of claim 15 wherein said $G_2$ electrode has a thickness $t_{G2}$ along said electron beam axis and each of said first and second recessed portions is generally circular having a diameter $d_{G2}$, where $t_{G2} \geqq 1.8\ d_{G2}$.

17. The electron gun of claim 16 wherein $t_{G2} \geqq 0.54-1.44$ mm and $d_{G2} = 0.3-0.8$ mm.

18. The electron gun of claim 17 wherein $r_1 + r_2 = d_{G2}'$ and $d_{G2}' = 10-50\%\ d_{G2}$.

19. The electron gun of claim 18 wherein said $G_2$ electrode is maintained at a potential of $V_{G2}$, where $300V \leqq V_{G2} < 0.12\ V_A$, where $V_A$ is an anode voltage.

20. The electron gun of claim 19 wherein said electron gun further includes a charged $G_1$ electrode disposed intermediate said cathode means and said $G_2$ electrode.

21. The electron gun of claim 11 wherein said high voltage asymmetric focusing means includes second and third electrodes disposed in a spaced manner along said electron beam axes, an wherein each of said second and third electrodes includes a respective common lens portion, with said common lens portions arranged in facing relation.

22. The electron gun for directing a focused electron beam on a display screen of a cathode ray tube (CRT), said electron gun comprising:

a cathode for providing energetic electrons;

low voltage beam forming means for receiving said energetic electrons, forming said energetic electrons into a beam along an axis, and directing said electron beam toward the display screen of the CRT, said beam forming means including a charged electrode having a thickness t along said axis for defining a substantially electrostatic field-free region on said axis;

high voltage asymmetric focus means for receiving said electron beam and applying an asymmetric electrostatic field to the beam in focusing the beam in the form of a spot on the display screen of the CRT, wherein said asymmetric electrostatic field gives rise to over-focusing of a peripheral portion of the beam resulting in beam spot spherical aberration; and means for defining a beam intercepting aperture on said axis and in said substantially electrostatic field-free region of said charged electrode for receiving and passing the electron beam to said asymmetric focus means, said beam intercepting aperture having an asymmetric shape with a horizontal width d for removing said peripheral portion of the beam and providing a beam cross section which compensates for the over-focusing of said asymmetric focus means to provide a rotationally symmetric, focused beam spot on the CRT display screen, where $t > d$.

23. The electron gun of claim 22 wherein said charged electrode is a $G_2$ screen electrode.

24. The electron gun of claim 23 wherein said means for defining said substantially electrostatic field-free region includes first and second recessed portions disposed on said electron beam axis and extending inwardly form respective facing surfaces of said charged electrode, and wherein said first and second recessed portions are separated by said means defining said beam intercepting aperture.

25. The electron gun of claim 24 wherein said means defining said beam intercepting aperture includes a thin wall disposed within said charged electrode on said electron beam axis and intermediate said first and second recessed portions.

26. The electron gun of claim 25 wherein said charged electrode has a thickness along said electron beam axis of $t_G$, and wherein each of said recessed portions has a generally cylindrical shape with a diameter of $d_G$, where $t_G \geqq 1.8\ d_G$.

27. The electron gun of claim 26 wherein said beam intercepting aperture is asymmetric about the axis of the electron beam for intercepting and removing electrons from an outer lateral portion of the electron beam.

28. The electron gun of claim 27 wherein said asymmetric focus means includes second and third electrodes disposed in spaced relation along said electron beam axis and intermediate said beam forming means and the display screen, and wherein each of said second and third electrodes includes a respective common lens portion, with said common lens portions arranged in facing relation.

* * * * *

UNITED STATES PATENT AND TRADEMARK OFFICE

CERTIFICATE OF CORRECTION

PATENT NO. : 5,182,492

DATED : January 26, 1993

INVENTOR(S) : Hsing-Yao Chen

It is certified that error appears in the above-identified patent and that said Letters Patent is hereby corrected as shown below:

ON THE COVER PAGE:

Under "References Cited" Section:

Patent No. 2,128,581 should be to --Gardner--
not "Garrdner"

Under "ABSTRACT"
7th line: "electron" should be --electrode--

| COLUMN | LINE | |
|---|---|---|
| 7 | 67 | Insert --,-- after "embodiment" |
| 10 | 7 | Insert --,-- after "4" |

UNITED STATES PATENT AND TRADEMARK OFFICE

CERTIFICATE OF CORRECTION

PATENT NO. : 5,182,492

DATED : January 26, 1993

INVENTOR(S) : Hsing-Yao Chen

It is certified that error appears in the above-identified patent and that said Letters Patent is hereby corrected as shown below:

| COLUMN | LINE | |
|---|---|---|
| 12 | 20 | "to" should be --t-- |
| 12 | 21 | "used" should be --said-- |
| 12 | 41 | "said" should be --each-- |
| 12 | 56 | "e" should be --3-- |
| 13 | 2 | ">" should be --≥-- |
| 13 | 5 | "$d_{G2}$ '" should be --$d_{G2}$'-- |

Signed and Sealed this

Second Day of November, 1993

Attest:

Bruce Lehman

BRUCE LEHMAN

Attesting Officer

Commissioner of Patents and Trademarks